US010344496B1

(12) United States Patent
Cefalo

(10) Patent No.: US 10,344,496 B1
(45) Date of Patent: Jul. 9, 2019

(54) ANCHORING DEVICE FOR A BEACH UMBRELLA

(71) Applicant: Adam S. Cefalo, Southampton, MA (US)

(72) Inventor: Adam S. Cefalo, Southampton, MA (US)

( * ) Notice: Subject to any disclaimer, the term of this patent is extended or adjusted under 35 U.S.C. 154(b) by 0 days.

(21) Appl. No.: 15/960,903

(22) Filed: Apr. 24, 2018

(51) Int. Cl.
*E04H 12/22* (2006.01)
*A45B 23/00* (2006.01)
*A45F 3/44* (2006.01)

(52) U.S. Cl.
CPC ..... *E04H 12/2215* (2013.01); *E04H 12/22* (2013.01); *E04H 12/2261* (2013.01); *E04H 12/2269* (2013.01); *A45B 23/00* (2013.01); *A45B 2023/0012* (2013.01); *A45B 2200/109* (2013.01); *A45F 3/44* (2013.01); *E04H 12/2238* (2013.01); *E04H 12/2246* (2013.01)

(58) Field of Classification Search
CPC ..... A45B 2023/0012; A45B 23/00; A45B 2200/109; E04H 12/2215; E04H 12/2238; E04H 12/2269; E04H 12/2246; E04H 12/2261; E04H 12/2253; E04H 12/2276; E04H 12/22; E04H 12/2292; A45F 3/44; E01F 9/685; E01F 9/677; E02D 5/80
USPC ..... 248/156, 530
See application file for complete search history.

(56) References Cited

U.S. PATENT DOCUMENTS 650,446 A * 5/1900 Barr ..... D06F 53/04 248/156
1,736,177 A * 11/1929 Snook ..... A47B 37/04 108/50.12
1,933,282 A * 10/1933 Schram ..... E04H 12/2215 52/158
2,533,322 A * 12/1950 Kober ..... A45B 23/00 135/16
2,643,843 A * 6/1953 Brown ..... E04H 12/2223 248/156
3,694,978 A * 10/1972 Mintz ..... E02D 27/42 52/166
3,823,785 A * 7/1974 Toliver ..... E04H 12/2215 173/128
3,887,154 A * 6/1975 Cornett ..... A45F 3/44 248/156
3,894,589 A * 7/1975 Ciraud ..... A01G 17/16 111/114
4,269,010 A * 5/1981 Glass ..... E04H 17/08 52/154
4,469,302 A * 9/1984 Stoudt ..... E04H 12/2215 248/512
4,649,678 A * 3/1987 Lamson ..... E01F 15/0469 248/530
4,753,411 A * 6/1988 Lechner ..... E04H 12/2215 248/156
4,926,785 A * 5/1990 Lamson ..... E04H 12/2215 116/209
5,122,014 A 6/1992 Genfan
(Continued)

*Primary Examiner* — Jonathan Liu
*Assistant Examiner* — Taylor L Morris

(57) ABSTRACT

An anchoring device for anchoring a pole to the ground comprising a ground engaging base element for engaging the ground to anchor the pole, having an aperture for receiving the pole; and a removable securing means for engaging the pole and the base element to prevent removal of the pole from the ground.

7 Claims, 5 Drawing Sheets

(56) References Cited

U.S. PATENT DOCUMENTS 5,165,663 A * 11/1992 Wells ..... E04H 12/2215 256/1
5,251,894 A * 10/1993 Boatman ..... A63B 69/0013 473/499
5,271,196 A * 12/1993 Fanti ..... E04H 12/2246 135/16
5,293,889 A 3/1994 Hall
5,347,667 A * 9/1994 Schwarz ..... A45B 23/00 135/16
5,358,209 A * 10/1994 Ward ..... E04H 12/2223 248/530
5,451,045 A * 9/1995 Garske ..... A63B 57/357 473/176
5,492,429 A * 2/1996 Hodges ..... E04H 12/2215 248/156
5,497,972 A * 3/1996 Sofy ..... A47F 5/04 248/523
5,535,978 A * 7/1996 Rodriguez ..... E04H 12/2269 135/118
5,636,944 A * 6/1997 Buttimore ..... E04H 12/2246 248/530
5,661,932 A * 9/1997 Barefield ..... E02D 5/80 52/154
5,899,030 A * 5/1999 Barefield ..... E02D 5/80 403/374.1
5,901,526 A * 5/1999 Vidmar ..... A01G 9/28 52/745.09
5,984,587 A * 11/1999 Odle ..... E01F 9/685 248/530
6,050,034 A * 4/2000 Krinner ..... E04H 12/2284 52/155
6,164,613 A * 12/2000 Williams ..... E04H 12/2246 248/533
6,330,887 B1 * 12/2001 Chen ..... A45B 19/04 135/114
6,354,554 B1 3/2002 Hollenbeck
6,494,643 B1 * 12/2002 Thurner ..... E04H 12/2223 248/156
6,520,192 B1 * 2/2003 Lo ..... A45B 19/04 135/114
6,887,016 B1 * 5/2005 Skeels ..... E02D 27/52 248/171
7,032,811 B1 * 4/2006 Paulic ..... A47G 29/1216 232/39
7,150,579 B2 * 12/2006 Newton ..... E04H 12/2269 404/11
7,241,079 B2 * 7/2007 Francis ..... E02D 5/56 248/530
7,380,561 B2 * 6/2008 Nobert ..... E04H 12/2215 135/118
7,406,975 B1 8/2008 Carrier, Jr.
7,413,522 B2 * 8/2008 O'Neill ..... A63B 63/083 473/479
7,520,485 B1 4/2009 Giannetto
7,559,218 B2 7/2009 Soudan, Jr.
D606,776 S 12/2009 Zubyk
7,627,994 B1 * 12/2009 Demirkan ..... E04H 12/2269 248/530
7,739,796 B2 * 6/2010 Froese ..... E04H 12/2253 29/897
7,779,589 B2 * 8/2010 Salman ..... E04B 1/4114 248/156
7,780,139 B2 * 8/2010 Markert ..... E04H 12/2261 135/15.1
7,827,747 B2 * 11/2010 George ..... E02D 27/16 248/346.01
7,954,289 B2 * 6/2011 Evans ..... E04H 12/2269 248/530
8,371,319 B2 * 2/2013 Meibos ..... A45B 23/00 108/50.12
8,444,105 B2 5/2013 Silvestri
8,474,773 B2 * 7/2013 Hull ..... A45F 3/44 248/156
D727,010 S 4/2015 Greto
9,232,836 B1 * 1/2016 Zaccaro ..... E02D 5/80
9,366,051 B1 * 6/2016 Wojtowicz ..... E04H 12/185
9,422,733 B2 * 8/2016 Ehsani ..... E04G 23/0218
9,554,630 B1 1/2017 Patel
9,834,906 B1 12/2017 Linares
10,094,138 B2 10/2018 Gharabegian
2002/0040957 A1 * 4/2002 Carter ..... E04H 12/2238 248/530
2003/0089833 A1 * 5/2003 Hsu ..... E04H 12/2215 248/532
2004/0129184 A1 * 7/2004 Kraker ..... A45B 25/00 108/50.12
2004/0159055 A1 * 8/2004 Stone ..... E02D 5/80 52/153
2004/0163336 A1 * 8/2004 Hsu ..... E04H 12/2223 52/157
2006/0016950 A1 * 1/2006 Bright ..... E04H 12/2246 248/346.03
2007/0204891 A1 * 9/2007 Zubyk ..... A45F 3/44 135/16
2008/0017226 A1 * 1/2008 Nobert ..... E04H 12/2215 135/16
2008/0224016 A1 * 9/2008 Defu ..... E04H 12/2246 248/523
2009/0020145 A1 1/2009 Zubyk
2010/0024855 A1 * 2/2010 Li ..... A45B 3/04 135/16
2010/0257794 A1 * 10/2010 Stark ..... E02D 5/80 52/158
2011/0047896 A1 * 3/2011 Vosbikian ..... A45F 3/44 52/165
2012/0085880 A1 * 4/2012 Lewis ..... B63B 17/00 248/523
2013/0037066 A1 2/2013 Dorr
2013/0206954 A1 * 8/2013 Wells ..... E04H 12/2246 248/523
2014/0270939 A1 * 9/2014 Intagliata ..... E01F 9/608 404/9
2015/0076313 A1 * 3/2015 Ma ..... A45B 23/00 248/514
2017/0022730 A1 * 1/2017 Mansueto ..... E04H 12/2269

* cited by examiner

ANCHORING DEVICE FOR A BEACH UMBRELLA

FIELD

A particularly exemplary application of the present invention relates to an anchoring device for a beach umbrella and for any device to be removably anchored to the ground, i.e., to sand, dirt, gravel, clay and the like.

BACKGROUND

The difficulties encountered in supporting umbrella poles are quite significant as attested to by the fact that many patents are directed to solving this problem. Firmly affixing the umbrella pole in the ground, within a reasonable time, typically requires equipment designed for this purpose.

In the past, various corkscrew devices, heavy metallic poles, hammers, and the like have been used to anchor the umbrella. Such devices, while for the most part effective, have significant drawbacks. For example, U.S. Pat. No. 5,122,014 to Genfan discloses an anchoring device for beach umbrellas that utilizes a pole equipped with a sharp pointed end fitted with propeller like blades attached to the sides of the pole. Although the Genfan device makes it easier for an individual to dig a hole, it still has its deficiencies. Carrying the sharp pointed pole end equipped with propeller-like blades is both cumbersome and dangerous. Others, such as U.S. Pat. No. 7,520,485 to Gannett, include a spiked end and a slide hammer to drive the pike into the ground.

More related to the present invention is U.S. Application Nos. 20070204891 and 20090020145 which disclose an umbrella holder comprising an anchoring device for digging and insertion into the ground, having an aperture therein for receiving the pole of the umbrella and a connecting means such as a snap button, pins, or buttons to secure the pole to the anchoring device.

SUMMARY

According to the present invention, an anchoring device for anchoring an item including a pole to the ground comprises: a ground engaging base element for engaging the ground to anchor the pole, having an aperture for receiving the pole; and press fitting securing means for engaging the pole and the base element to prevent removal of the pole from the ground.

According to an embodiment of the present invention, an anchoring device for anchoring a pole to the ground comprises: a ground engaging base element, having an aperture for receiving the pole and for mating with the pole through a compression element in a press fitting relationship. The device includes a press fitting securing means, including a mating ring means and a compression ring means, that encircles the pole, such that the mating ring means and the compression ring means cooperate to constrain, secure, press bind, press fit, interference fit, or act in a binding relationship, hereinafter referred to as secure or bind, when the mating means and the compression ring means are pushed together, so as to removably secure the pole to the mating ring means and thereby the ground engaging base element.

A further embodiment of the present invention comprises a ground engaging base element having a plate like configuration, which may be grasped by a user for digging into the ground. The base element includes an aperture therein for receiving the pole there through. The invention further includes a press fitting securing means, including a mating ring means, separate from and disposed beneath the base element, having an aperture for receiving the pole there through, and flexible binding means or compression ring means, which encircles and frictionally engages the pole and which will also engage the mating ring means about the edges and sidewall of the mating ring means aperture in order to press fit or removably secure the pole to the mating ring means. The press fitting securing means engages the pole in a press fitting or frictional manner as force is applied between the pole and the mating ring means in a manner along the axis of the pole and in a direction upwardly, that is, away from the bottom of the pole. With the pole secured to the mating ring means, movement of the pole outwardly out of the ground forces the securing means and, in particular, the mating ring means into engagement with the ground engaging base element which thereby anchors the pole.

More specifically, in one embodiment of the invention, the compression ring means comprises an O-ring. In another embodiment of the invention, the compression ring means comprises material capable of being wrapped about the pole.

In another aspect of the invention, a method of anchoring a beach umbrella comprises the steps of: digging a hollow in the ground, of a size to accommodate the size of the ground engaging base element and deep enough to buy the base element; inserting the pole of the umbrella through the aperture in the ground engaging base element and through the mating ring means, such that a first portion of the pole extends upwardly away from the ground and a second portion of the pole extends downwardly from the ground engaging base element; attaching the compression ring means to the second portion of the pole beneath the mating ring means; and burying the ground engaging base element including the compression ring means within the hollow in the ground.

It is to be understood that both the foregoing general description and the following detailed description are exemplary and explanatory only and are not restrictive of the invention as claimed. Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

DETAILED DESCRIPTION

Figure 1:
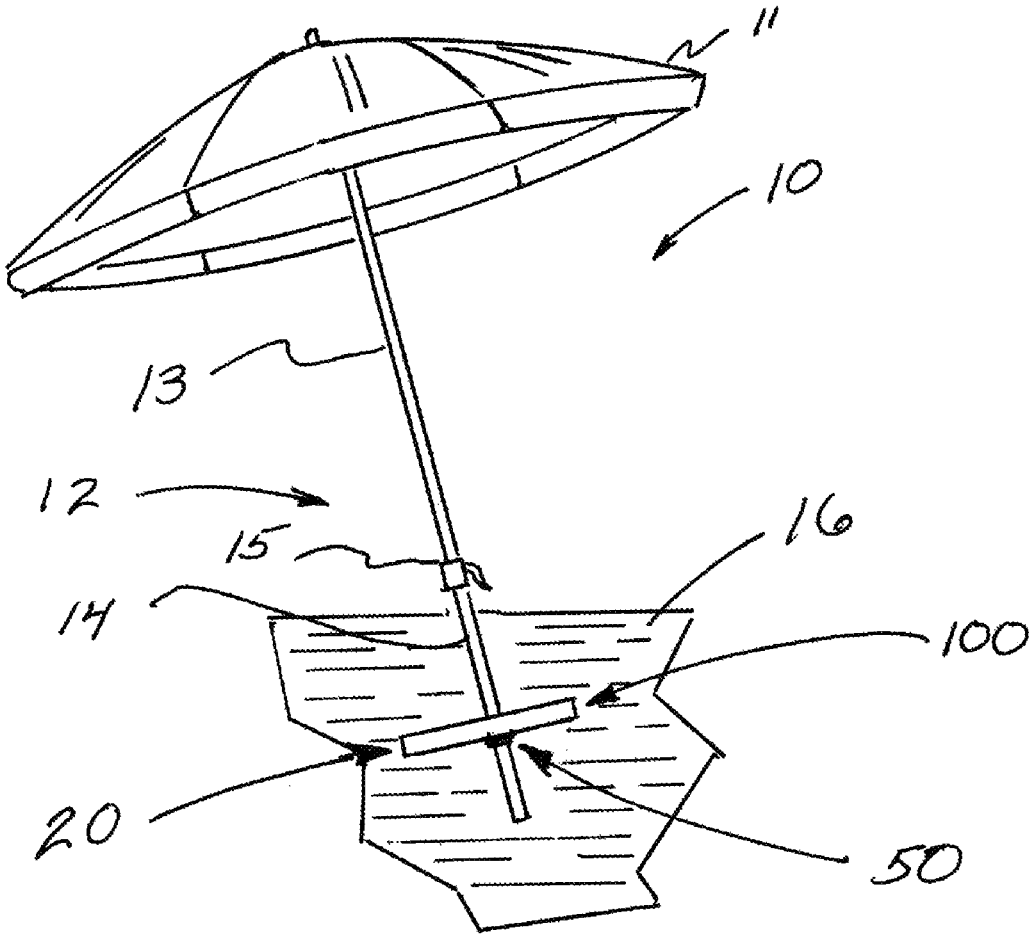
FIG. 1 is schematic of a beach umbrella and the anchor of the invention.

Reference will now be made in detail to the present exemplary embodiments, examples of which are illustrated in the accompanying drawings. Wherever possible, the same or similar reference numerals will be used throughout the drawings to refer to the same or like parts.

An embodiment of the invention is shown in FIG. 1 in connection with a beach umbrella 10 having an awning or canopy 11, a supporting pole 12 having an upper portion 13 and a lower portion 14 coupled together through a latching device 15. The umbrella is anchored in the ground or sand 16 by an embodiment of the anchoring device 100 of this invention.

The anchoring device 100 comprises a ground engaging base element 20 and a press fit removable securing means or press fitting means 50. In one embodiment of the invention, the ground engaging base element 20 comprises a plate 21 (FIG. 2), which may be flat or curved, round, oblong or rectangular, having an aperture as defined by the edge 22 (FIG. 2) therein for the lower pole portion 14 to extend there through. The base element 20 may be made of any material of suitable stiffness and size such that when buried in the ground or sand 16 it will engage the ground 16 such as to anchor the umbrella 10 secured thereto, as hereinafter described.

The press fit removable securing means 50 comprises a mating ring means 25 and a compression ring means 24, wherein the compression ring means encircles a limited length section of the pole portion 14. The press fit removable securing means 50 acts to press fit or fasten the pole 14 to the mating ring means 25 when the mating ring means 25 and that portion of the pole with the compression ring means 24 are pushed together.

Figure 2:
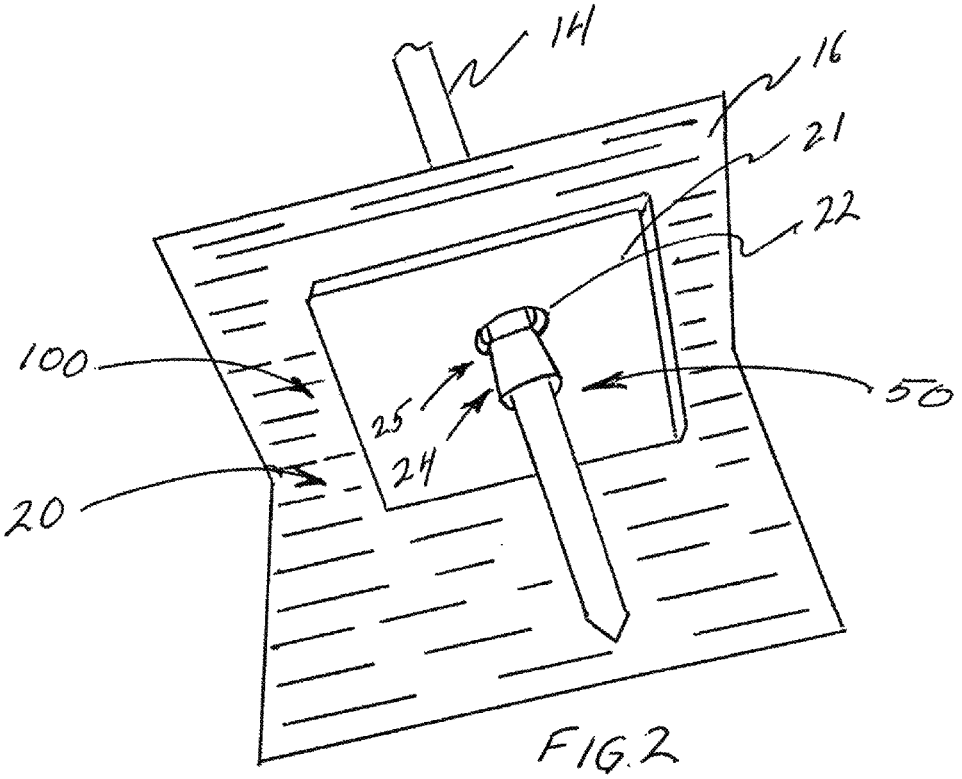
FIG. 2 is a more detailed schematic of the anchor of the invention showing the ground engaging base element and the press fitting securing device, wherein the ground engaging base element includes the mating ring means.

In the embodiment of the invention shown in FIG. 2, the mating ring means 25 includes the aperture edge 22 and the aperture sidewall 23 of the ground engaging base element 20. The aperture edge 22 and sidewall 23 are of a size to allow the pole 14 to slide there through. As shown in FIG. 2, compression ring means 24 engages the side walls 23 to affix, clamp, connect, bind, press fit, constrain, make secure, cinch, or frictionally attach, hereinafter referred to as "secure", in a removable fashion, the press fit removable securing means 50 to the pole portion 14 when the mating ring means 25 and that portion of the pole with the compression ring means 24 are pushed together. More specifically, in this embodiment of the invention wherein the ground engaging base element comprises the mating ring means 25, the press fit of the removable securing means 50 secures the ground engaging base element 20 to the pole portion 14.

Figure 3:
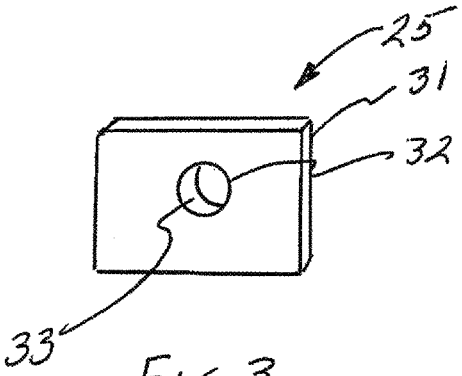
FIG. 3 is an oblique view schematic of a mating ring means, not part of the ground engaging base element, having an aperture sidewall essentially parallel to the axis of the aperture.
Figure 4:
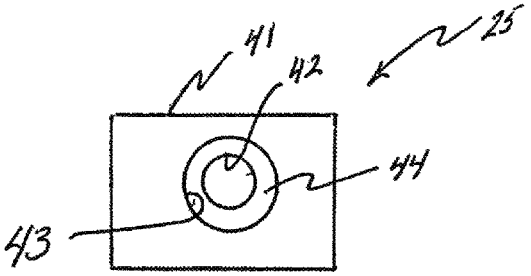
FIG. 4 is a bottom view of a mating ring means, not part of the ground engaging base element, including an aperture on the bottom side having a larger diameter than the aperture on the top side thereby forming a slanted sidewall.

As is readily understood, the mating ring means 25 of the press fit removable securing means 50 may be formed as part of the ground engaging base element 20, as shown in FIG. 2, or the mating ring means 25 may be formed as a separate element mating ring means 31, as shown in FIGS. 3 & 4, separate from the ground engaging base element 20.

The separate element mating ring means 25, shown in FIG. 3, may be formed as a plate 31 and includes an aperture edge 32 and sidewall 33 corresponding to the aperture edge 22 and aperture sidewall 23 of the mating ring means of the ground engaging base element 20 of FIG. 2. In this embodiment of the press fit removable securing means 50, the separate element mating means 31 press fits to the pole 14 as described above through the compression ring means 24 when the mating ring means 25 and that portion of the pole with the compression ring means 24 are pushed together. Furthermore, in this embodiment of the invention, the separate element mating means 31 is disposed beneath the ground engaging base element 20, so that upon movement of the pole 14 in the upward direction out of the ground 16 the press fit removable securing means 50 or, more specifically, the separate element mating means plate 31 engages or comes into contact with the ground engaging base element 20 which anchors the pole to the ground. It is noted that as used herein, the word above refers to the direction above the ground where the word below refers to the direction towards the ground.

In a further embodiment of the invention shown in FIG. 4, the press fit removable securing means 50 comprises a separate element mating ring means 25 formed as a plate 41 having an aperture 42 on its top side of a size to accommodate the pole 14, and a bottom aperture 43 of a larger dimension than the top aperture 42, such that a slanted sidewall 44 is formed. Again, it is noted that the mating ring means 25 of the press fit removable securing means 50 of FIG. 4 may be formed as part of the ground engaging base element 20, as shown in FIG. 2 or a as a separate element mating ring means 41 as shown in FIGS. 3 & 4.

Figure 5:
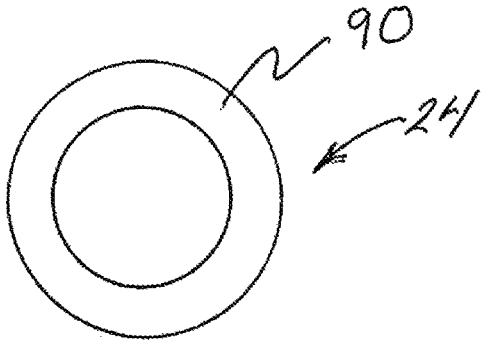
FIG. 5 is a schematic of a compression ring means of the invention as an O-ring.

In the embodiment of the invention shown in FIG. 4, it has been found that the compression ring means 24 may be formed by an O-ring 90 (FIG. 5) having a Shore A hardness of 50 to 70, such that when the mating ring means 41 and that portion of the pole with the compression ring means 24 are pushed together or movement of the pole 14 in an upward direction forces the compression ring means 24 against the mating ring means, the force or movement forcibly presses or binds the O-ring 90 against the slanted sidewall 44 of the separate element mating ring means 41 securing the mating ring means 41 to the pole 14.

Figure 6:
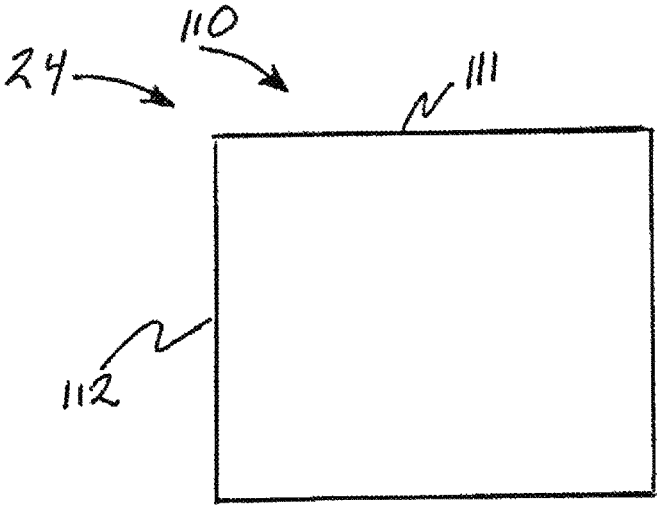
FIG. 6 is a front view schematic of a compression ring means of the invention as a sheet of a flexible material.

In a further embodiment of the invention shown in FIG. 6, the compression ring means 24 may be a flat piece of material 110, such as leather, a nitrile rubber, a synthetic rubber copolymer or the like, of sufficient size, width 111 to encircle the pole 14 and length 112, to ensure frictional engagement of the pole 14 and to press fit to the sidewall 23 or 33.

In addition, it has been found by the inventor that it is desirable to have the compression ring means 24 have a gradually increasing diameter, e.g., a conical shape, such that as more tension is placed on the pole 14 to remove it from the ground, more of the compression ring means 24 engages or press fits with the mating ring means 25 thereby increasing the binding, securing or press fitting to the pole 14. In this event, a flat material compression ring means 24 may be helically wrapped about the pole 14 such that overlapping portions of the material 24 increase the diameter of the compression ring means 24 in a conical fashion to ensure engagement or press fitting with the mating ring means 25.

Figure 7:
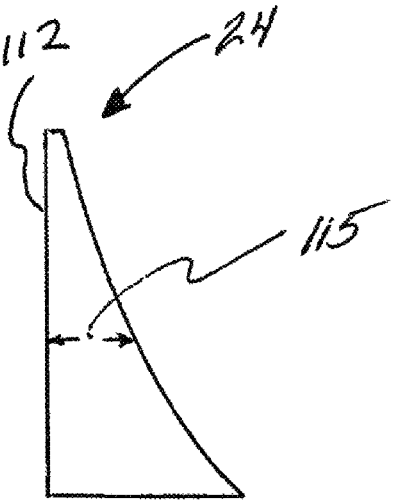
FIG. 7 is a side view of a sheet of a compression ring means of flexible material of the invention having an increasing thickness along one dimension of the sheet of material

Furthermore, the compression ring means 24 may be a piece of material, as mentioned above, of sufficient width to encircle the pole 14 and which has an increasing thickness 115, as measured along its length 112 parallel to the pole, as shown in FIG. 7, to increasing engage the mating ring means 25.

Figure 8:
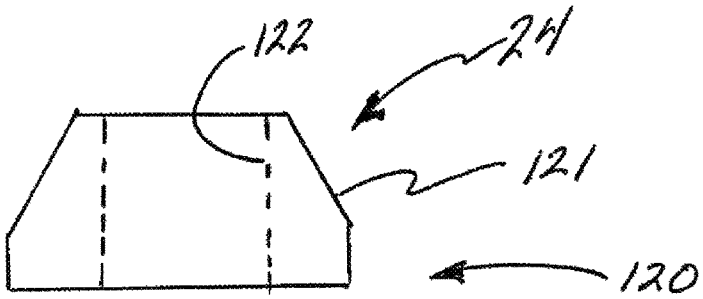
FIG. 8 is a schematic of a compression ring means of the invention as a conical ring.

It is further noted that the flexible engagement means 24 may be formed of a conical O-ring 120 (FIG. 8) whose conical sides 121 engage the mating ring means 25 of the removable securing means 50. Of course, if the compression ring means 24 is a conical O-ring of FIG. 12, it must have a central aperture 122 whose diameter is such that the conical O-ring can be installed and frictionally engage the pole 14.

Figure 9:
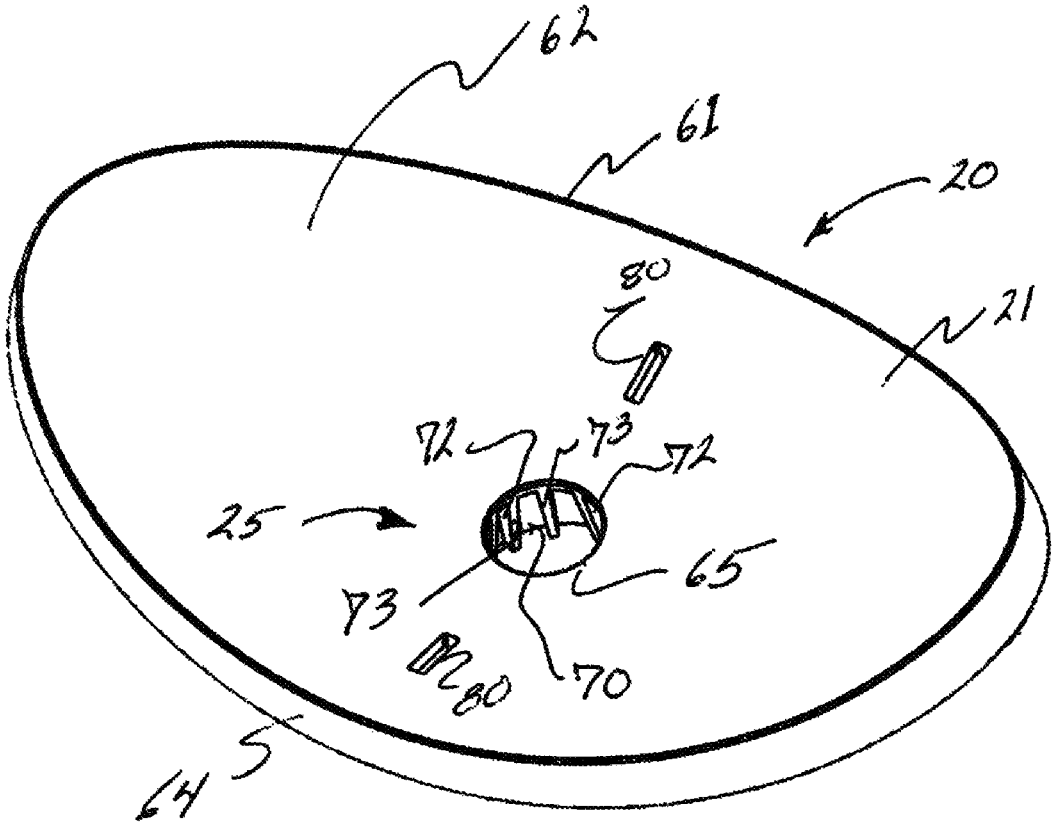
FIG. 9 is an oblique top view of a preferred embodiment of the invention shown in FIGS. 1 & 2 including the ground engaging base element and the mating ring means.
Figure 11:
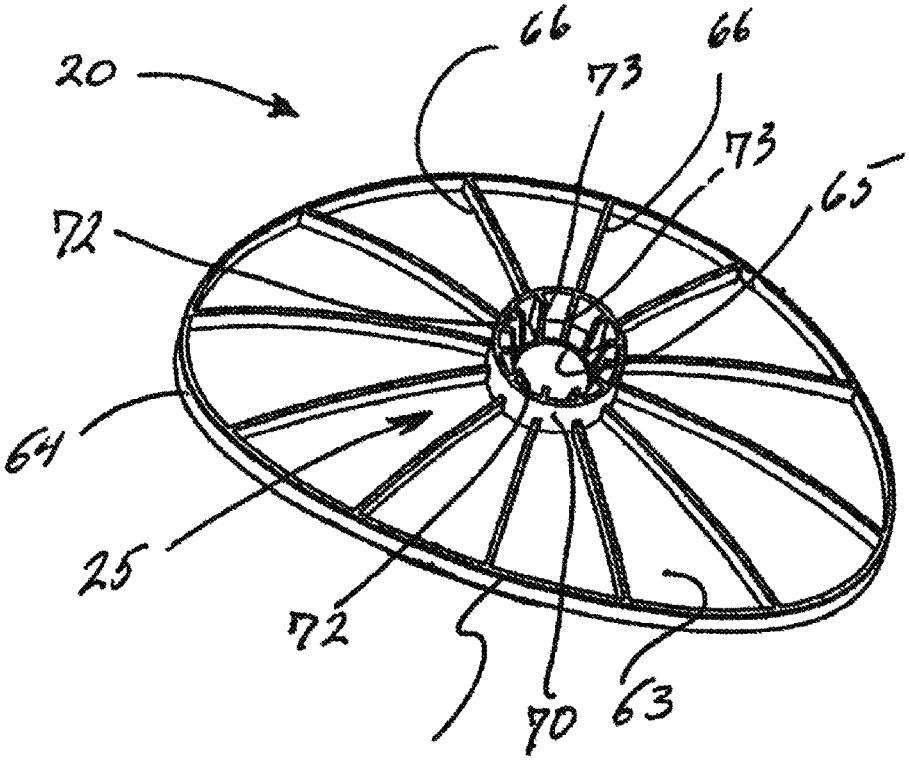
FIG. 11 is an oblique view from the bottom of the preferred embodiment of the invention shown in FIG. 9
Figure 10:
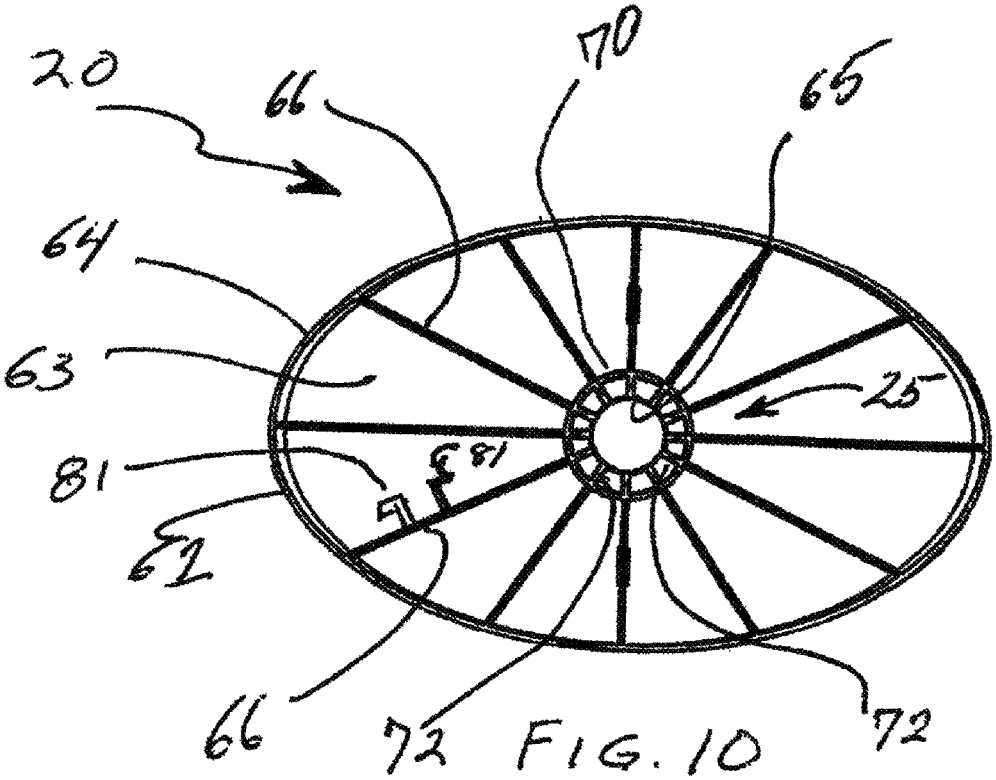
FIG. 10 is a bottom view of the preferred embodiment of the invention shown in FIG. 9.

FIGS. 9, 10 & 11 illustrate the preferred embodiment of the invention comprising a ground engaging base element 20 formed of a plate 21 having an elliptical contour 61 and an upwardly curving configuration, a top face 62, a bottom face 63 (FIGS. 10 & 11), sidewall 64 and ribs 66 (FIGS. 10 & 11). The upwardly facing top face 62 of the base element 20 is concave for ease of digging into the ground or sand 16. The ribs provide structural strengthen to the base element 20. In this preferred embodiment, the base element 20 includes an aperture 65, which is of a size to allow the pole 14 to readily pass through. In addition, the mating ring means 25 of the press fit removable securing means 50 is formed as a part of the base element 20 as further described herein. In this embodiment of the invention, the mating ring means 25 is shown as an extended cylindrical portion 70 thereby providing more structural integrity than the base element face material for securing the pole 14. Furthermore, the mating ring means 25 and, more specifically, the extended cylindrical portion 70, is formed with inwardly projecting rib portions 72 on the inside of the cylindrical portion 70. The rib portions 72 include faces or lands 73 which are slanted outwardly from the center of the aperture in the downward or bottom direction such that they effectively form an aperture at the bottom of the mating ring means 25 having a larger diameter than the aperture 65 on the top face 62 of the base element 20, that is, a slanted aperture as in FIG. 4.

In this preferred embodiment of the invention, it has been found that the compression ring means 24 should be an O-ring 90 (FIG. 5), which gets compressed or pressed against the rib like portions 72 and more specifically against the lands 73 and against the pole 14 thereby securing the base element 20 to the pole 14. It is noted that O-rings of Buna-Nitrile from the O-Ring Store, Clarkston, Wash., have been successfully employed by the inventor. Such O-rings with a Shore A hardness of 50 to 70 are considered appropriate compression ring means of this invention.

In this preferred embodiment, the base element 20 may include at least one slot like aperture 80 to store the flexible compression ring 24 or may include 2 oppositely facingL-shaped projections 81 on which to catch and store the O-ring 90.

In use the base element 20 may be used to dig a hollow in the ground, the bottom portion of the umbrella pole 14 is slid through the aperture 65 in the base element 20 and through the mating ring means 25 of the press fit removable securing device 50. The compression ring means 24 is placed on the pole 14 and the compression ring means 24 is pushed into contact with the mating ring means 25. The umbrella pole 14 with the base element 20 and press fit removable securing means 50 are placed in the hollow and the base element 20 is covered with the ground material removed from the hollow thereby providing support to the umbrella pole. It is understood that if the mating ring means 25 is formed as part of the base element 20, then the compression ring means 24 is press fit against the mating means 25 and the pole 14. It is noted that, if the mating means is a separate element, as in FIGS. 3 and 4 above, the pole is inserted through the base element 20, then through the mating ring means 25, and the compression ring means 24 is placed on the pole 14 and the compression ring means 24 is pushed into contact with the mating ring means 25 and the mating ring means 25 is pushed into contact with the separate base element 20. The umbrella pole 14 with the base element 20 and press fit removable securing means 50 are placed in the hollow and the base element 20 is covered with the ground material removed from the hollow thereby providing support to the umbrella pole.

While the foregoing description represents a preferred embodiment of the invention, many modifications and variations of the present invention are possible in light of the teachings herein. Thus, it is to be understood that, within the scope of the appended claims, the invention may be practiced otherwise than is specifically described above.

What is claimed and desired to be secured by a Letters Patent of the United States is:

1. An anchoring device for anchoring an item including a pole to the ground wherein a portion of the pole extends within the ground comprising: a ground engaging base element disposed about said portion of the pole that extends within the ground, the base element having a plate configuration, including a top surface for engaging the ground above the base element, the base element having an aperture which extends through the base element for receiving the pole portion which extends within the ground, the base element further having radial ribs extending from the aperture to an outer edge of the base element, one of the radial ribs of the base element having oppositely facing "L"-shaped projections extending therefrom; and a press fitting securing means disposed about the aperture and below the top surface of the base element, including: a mating ring means having inwardly facing edges, for receiving the pole portion which extends through the aperture, and a compression ring means disposed below the top surface of the base element, which engages the inwardly facing edges of the mating ring in a press fitting relationship for securing the pole portion which extends within the ground to the press fitting securing means to prevent removal of the pole from the ground.

2. An anchoring device for anchoring a pole to the ground according to claim 1 wherein the press fitting securing means includes an aperture having a straight side wall.

3. An anchoring device for anchoring a pole to the ground according to claim 1 wherein the press fitting securing means includes an aperture having at least one slanted side wall formed by an edge of said inwardly facing edges.

4. An anchoring device for anchoring a pole to the ground according to claim 1 wherein the compression ring means comprises flexible engaging material.

5. An anchoring device for anchoring a pole to the ground according to claim 4 wherein the flexible engaging material is an O-ring.

6. An anchoring device for anchoring a pole to the ground according to claim 5 wherein the O-ring has a Shore A hardness of 50 to 70.

7. A method of anchoring a beach umbrella having a pole to the ground comprises the steps of: providing a ground engaging base element according to claim 1; providing a hollow in the ground, of a size to accommodate the ground engaging base element; and inserting the pole through the aperture in the ground engaging base element and through the aperture in the mating ring means.

* * * * *